United States Patent [19]

Pav et al.

[11] Patent Number: 4,491,283

[45] Date of Patent: Jan. 1, 1985

[54] APPARATUS FOR CONVOLUTING WEBS OF PAPER OR THE LIKE

[75] Inventors: Josef Pav; Gerhard Hartwich, both of Krefeld; Jörg Prey, Tönisvorst, all of Fed. Rep. of Germany

[73] Assignee: Kleinewefers GMBH, Krefeld, Fed. Rep. of Germany

[21] Appl. No.: 485,632

[22] Filed: Apr. 18, 1983

[30] Foreign Application Priority Data

Apr. 20, 1982 [DE] Fed. Rep. of Germany ..... 3214396

[51] Int. Cl.[3] ..... B65H 17/02

[52] U.S. Cl. ..... 242/67.1 R; 242/67.2; 242/67.5

[58] Field of Search ..... 242/67.1 R, 67.2, 67.3 R, 242/65, 67.5, 78.1, 55, 56 R; 226/95; 34/153, 154, 92

[56] References Cited

U.S. PATENT DOCUMENTS

| | | | |
|---|---|---|---|
| 3,592,403 | 7/1971 | Schmitt | 242/65 X |
| 3,761,034 | 9/1973 | Service | 242/67.3 R X |
| 3,869,095 | 3/1975 | Diltz | 242/67.1 R X |
| 3,908,924 | 9/1975 | Schulze | 242/56 A X |
| 4,004,747 | 1/1977 | Schulze | 242/67.2 X |
| 4,179,330 | 12/1979 | Page | 242/65 X |
| 4,343,440 | 8/1982 | Engl | 242/67.2 X |
| 4,351,687 | 9/1982 | Lesage | 242/56 R X |

*Primary Examiner*—John M. Jillions
*Assistant Examiner*—Leo J. Peters
*Attorney, Agent, or Firm*—Peter K. Kontler

[57] ABSTRACT

Apparatus which winds a running web onto a driven takeup reel employs a distancing roller which is spaced apart from the outermost convolution of growing roll on the reel and is moved away from the reel at a rate which is proportional to the rate of growth of the roll so that its spacing from the outermost convolution of the roll remains unchanged. A suction generating device is provided to evacuate air from a substantially gusset-shaped space which is defined by the outermost convolution of the growing roll and the web portion which advances from the distancing roller to the roll. This reduces the likelihood of entrapment of air between neighboring convolutions of the roll on the takeup reel. The likelihood of entrapment of air is further reduced by wiping air off one side of the web in the region of the distancing roller, by wiping air from the outer side of the outermost convolution of the roll upstream of the gusset-shaped space, and/or by causing a roller to bear against the outer side of the web immediately downstream of the locus where successive increments of the running web reach the roll.

33 Claims, 2 Drawing Figures

APPARATUS FOR CONVOLUTING WEBS OF PAPER OR THE LIKE

BACKGROUND OF THE INVENTION

The present invention relates to apparatus for converting a running web of paper or the like into a roll whose convolutions surround the core of a takeup reel. More particularly, the invention relates to improvements in winding apparatus of the type wherein the means for feeding the web to the takeup reel comprises a distancing member, e.g., a roller, and the apparatus further comprises means for changing the spacing between the distancing member and the reel so that the clearance between the distancing member and the outermost convolution of the growing roll on the takeup reel remains at least substantially unchanged.

Apparatus of the above outlined character are used extensively in paper processing and many other plants. Reference may be had to an apparatus which is known as Sensomat and is manufactured and sold by the assignee of the present application. The distancing member of such apparatus is a roller which is parallel to the roll of convoluted material on the takeup reel and is movable between a first position of contact with the outermost convolution of the roll and a second position at a selected distance from the outermost convolution. The position of the distancing roll with reference to the takeup reel is selected as a function of the nature of the material of the web and of the speed of lengthwise movement of the running web with a view to reduce the quantity of air which is entrapped between successively formed convolutions of the roll when the material of the web is paper, a synthetic plastic substance or the like. This results in the formation of a compact roll and reduces the likelihood of telescoping. The spacing between the distancing roller and the takeup reel is varied by two hydraulic cylinder and piston units which can shift the bearings for the distancing roller in stepwise fashion in response to signals which are generated by means for monitoring the clearance between the distancing roll and the takeup reel.

OBJECTS AND SUMMARY OF THE INVENTION

An object of the invention is to provide a winding apparatus which can properly convolute webs consisting of a variety of materials including strongly coated paper webs and pressure-sensitive webs as well as webs which are transported at a high or extremely high speed.

Another object of the invention is to provide the winding apparatus with novel and improved means for reducing the likelihood of entrapment of air between neighboring convolutions of the growing roll on the takeup reel.

A further object of the invention is to provide a winding apparatus which can properly convolute narrow or wide webs and which can be used as a superior and more versatile substitute for heretofore known winding apparatus.

An additional object of the invention is to provide the winding apparatus with novel and improved means for treating the running web between the distancing means and the growing roll on the takeup reel.

A further object of the invention is to provide a winding apparatus which is constructed and assembled with a view to prevent the entrapment of air between successive convolutions of the growing roll in a number of different ways.

Still another object of the invention is to provide the winding apparatus with novel and improved means for compacting the growing roll to further reduce the likelihood of inclusion or entrapment of air between neighboring convolutions of the roll on the takeup means.

An additional object of the invention is to provide a winding apparatus which can make densely packed rolls of paper or the like without subjecting the web to pronounced tensional stresses.

The invention is embodied in a winding apparatus which serves to convolute a web of paper, metallic foil, synthetic plastic material or the like. The apparatus comprises a driven reel or an analogous rotary takeup device and means for feeding the web from a source of supply to the takeup device along a predetermined path so that the takeup device converts the running web into a growing roll consisting of neighboring convolutions. The feeding means comprises a distancing device (e.g., a roller which is parallel to the roll of convoluted material on the takeup device) which is adjacent to a predetermined portion of the path and is spaced apart from the outermost convolution of the roll on the takeup device. The apparatus further comprises means for moving at least one of the two (takeup and distancing) devices with reference to the other device (e.g., for moving the distancing roller with reference to the takeup device) so as to maintain the spacing between the distancing device and the outermost convolution of the roll on the takeup device at an at least substantially constant value, and means for reducing the pressure of air at least at one side of the running web intermediate the distancing device and the outermost convolution of the roll on the takeup device. The one side of the web is preferably that side which faces the roll on the takeup device. The pressure reducing means preferably comprises suction generating means.

The distancing device is preferably mounted in such a way that it directs the running web substantially tangentially of and toward the roll on the takeup device so that the outermost convolution of the roll and the web portion between the distancing device and the roll define a substantially gusset-shaped space. The pressure reducing means is arranged to evacuate air from (i.e., to generate suction in) such space, and the pressure reducing means preferably comprises wall means serving to at least partially separate the gusset-shaped space from the surrounding atmosphere. The wall means preferably extends from the periphery of the roll on the takeup device (i.e., from the outermost convolution of the roll) to the periphery of the roller which constitutes or forms part of the distancing device. The pressure reducing means can further comprise an elongated hollow beam which is parallel with the axis of the roller of the distancing device and defines an elongated suction chamber. Such beam is preferably formed with a series (e.g., a straight row) of suction ports which extend in exact or substantial parallelism with the axis of the roller and establish communication between the gusset-shaped space and the suction chamber. The wall means includes a first portion which constitutes or includes the aforementioned beam and a second portion which is carried by the beam and extends to the outermost convolution of the roll on the takeup device.

Alternatively, or in addition to the aforedescribed parts, the pressure reducing means can comprise a flow restrictor which is adjacent to the outermost convolution of the roll on the takeup device and defines with the web portion between the distancing device and the roll a gap having a central portion of lesser width and two outer portions of greater width. Such design of the gap entails an automatic reduction of air pressure in the aforementioned space. The gap extends in the direction of advancement of the web from the distancing device to the roll on the takeup device. The flow restrictor is preferably provided with a convex external surface (this flow restrictor can constitute an elongated rod-like member which is parallel to the roll and has a circular cross-sectional outline) so that the width of the two outer portions of the gap increases gradually in directions away from the central portion of the gap. In such embodiment of the improved winding apparatus, the flow restrictor can constitute or form part of a first portion of the aforementioned wall means, and the second portion of the wall means then extends from the flow restrictor toward the distancing device and can include the aforementioned beam. In other words, the pressure in the gusset-shaped space can be reduced by connecting such space with a suction generating device as well as by simultaneously establishing the aforementioned gap.

The apparatus can further comprise one or more doctors or analogous means for stripping air from the exposed surface of the outermost convolution of the roll on the takeup device (preferably immediately upstream of the aforementioned space) and/or from one side of the web in the region where the web is engaged by the distancing device (i.e., again immediately ahead of the aforementioned space). The stripping means can comprise one or more flexible wipers which extend radially or substantially radially of the roll on the takeup device or of the roller which constitutes or forms part of the distancing device.

The means for moving the one device preferably comprises adjusting means which is operable to continuously shift the one device, signal generating means which monitors the spacing between the distancing device and the roll on the takeup device, and a regulating or control circuit or other suitable means for operating the adjusting means in response to signals from the monitoring means. If the one device is the roller of the distancing device, the moving means is designed to move the bearing or bearings for the roller in a predetermined direction (e.g., along a straight path which extends substantially radially of the roll on the takeup device). The monitoring means is movable with the bearing means (the bearing means can form part of or may be provided on a reciprocable carriage which supports the monitoring means) and can constitute an optical detector which senses the spacing between the roller and the outermost convolution of the roll on the takeup device. The aforementioned wall means has an end portion (e.g., one of the aforementioned wipers) which is immediately adjacent to the outermost convolution of the roll; such end portion of the wall means and the monitoring means are preferably mirror symmetrical to one another with reference to a plane which includes the axis of the takeup device and extends in parallelism with the direction of movement of the one device relative to the other device.

The distancing device establishes a predetermined line of contact between successive increments of the running web and the roll on the takeup device (such line is parallel to the axis of rotation of the takeup device and moves radially outwardly of the takeup device as the diameter of the roll grows). The distancing device engages the running web at one side of such line of contact and the apparatus preferably further comprises a roller element or other suitable means for biasing the web against the roll at the other side of the aforementioned line of contact. The roller element is in substantially linear contact with the web, and the apparatus preferably further comprises means for moving the roller element relative to the takeup device so that the distance from the line of contact between successive increments of the running web to the roll on the one hand and the locus of linear contact of the roller element with the web on the other hand remains at least substantially unchanged while the diameter of the roll on the takeup device grows. The means for moving the roller element of the biasing means can comprise a carriage and means for moving the carriage along a path which makes an acute angle with the direction of movement of the one device. If the one device is the roller which constitutes or forms part of the distancing device, the path along which the bearing or bearings for the roller are movable is preferably a straight path which makes the aforementioned acute angle with the direction of movement of the roller element. The apparatus preferably comprises rails or other suitable guide means defining for the carriage of the roller element a straight path which is inclined with reference to the path of movement of the bearing or bearings for the roller of the distancing device.

The carriage is preferably shiftable along its guide means by one or more fluid-operated motors in accordance with a preselected program which is a function of the rate of growth of the roll on the takeup device. The motor or motors can shift the roller element so as to regulate its bias upon the roll and/or to change the distance between the roller element and the takeup device as a function of the growing diameter of the roll on the takeup device. For example, the apparatus can comprise means for monitoring the pressure of fluid (e.g., oil) in the motor and means for changing the pressure of such fluid in the motor when the monitored pressure deviates from a preselected range of values as the diameter of the roll on the takeup device increases.

The novel features which are considered as characteristic of the invention are set forth in particular in the appended claims. The improved winding apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
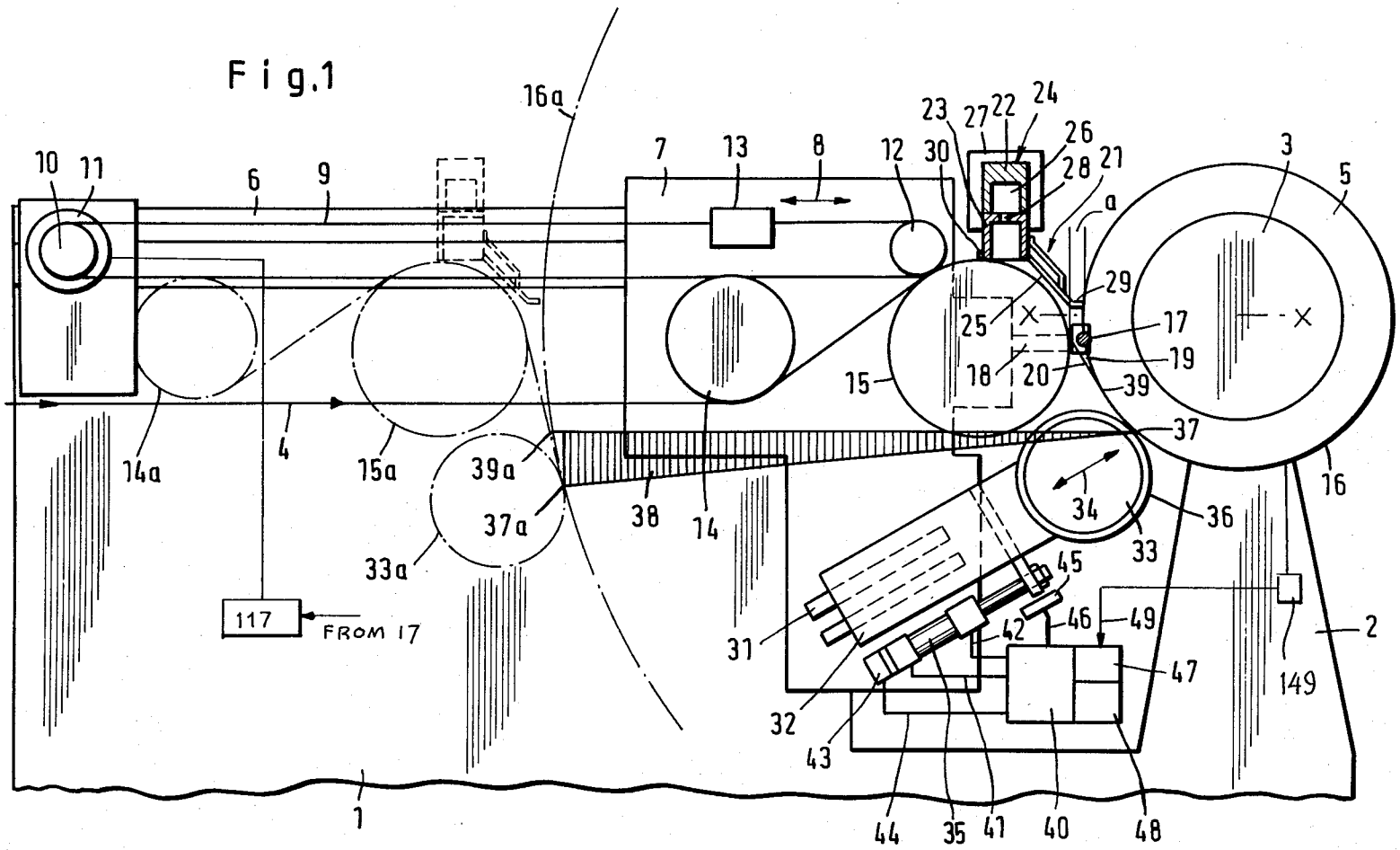
FIG. 1 is a fragmentary schematic partly elevational and partly vertical sectional view of an apparatus which embodies one form of the invention, the outermost convolution of the fully grown roll of convoluted paper or the like being indicated by a phantom line.

The winding apparatus which is shown in FIG. 1 comprises a frame or support 1 having an upright column 2 (or two spaced-apart upright columns) supporting the driven shaft of a takeup reel or winding drum 3 which is rotated by a suitable motor (not shown) to gather a growing roll 5 consisting of a web 4 of paper of the like. The frame 1 further comprises a horizontal supporting arm 6 constituting a guide for a carriage 7 which is reciprocable in directions indicated by a double-headed arrow 8. The carriage 7 is movable back and forth by a chain 9 which is trained over two sprocket wheels 10 and 12. The sprocket wheel 10 is mounted on the arm 6 of the frame 1, and the sprocket wheel 12 is also mounted in or on the frame 1. The sprocket wheel 10 can be driven by an adjusting motor 11 (e.g., a hydraulic motor). A tensioning device 13 couples the chain 9 to the carriage 7 so that the latter moves in a direction to the left or to the right, depending upon the direction in which the sprocket wheel 10 is rotated by the motor 11.

The means for feeding the web 4 in a direction toward and into the range of the takeup reel 3 comprises a spreader roller 14 and a distancing roller 15. The rollers 14 and 15 are mounted on and thus share all movements of the carriage 7 with reference to the frame 1 and takeup reel 3. The reference character a denotes the spacing between the distancing roller 15 and the outermost convolution 16 of the roll 5 on the takeup reel 3. A preferably optical monitoring device 17 scans the distance between the outermost convolution 16 of the growing roll 5 and the periphery of the distancing roller 15 and transmits signals which are processed by a suitable circuit 117 to operate the adjusting motor 11 and to thus ensure that the spacing a remains at least substantially constant while the rollers 14 and 15 feed the web 4 into the range of the takeup reel 3 so that the diameter of the roll 5 grows at a rate which is a function of the speed of lengthwise movement and of the thickness of the web 4. The monitoring device 17 is mounted on a carrier 18 of the carriage 7. The source from which the rollers 14 and 15 draw the web 4 is not shown in the drawing. When the diameter of the roll 5 reaches its maximum value, the outermost convolution of the fully grown roll is located at 16*a* (indicated by an arcuate phantom line) and the carriage 7 (which can be said to constitute a mobile bearing for the distancing roller 15 and spreader roller 14) then maintains the parts 14 and 15 in phantom-line positions which are respectively shown at 14*a* and 15*a*.

Figure 2:
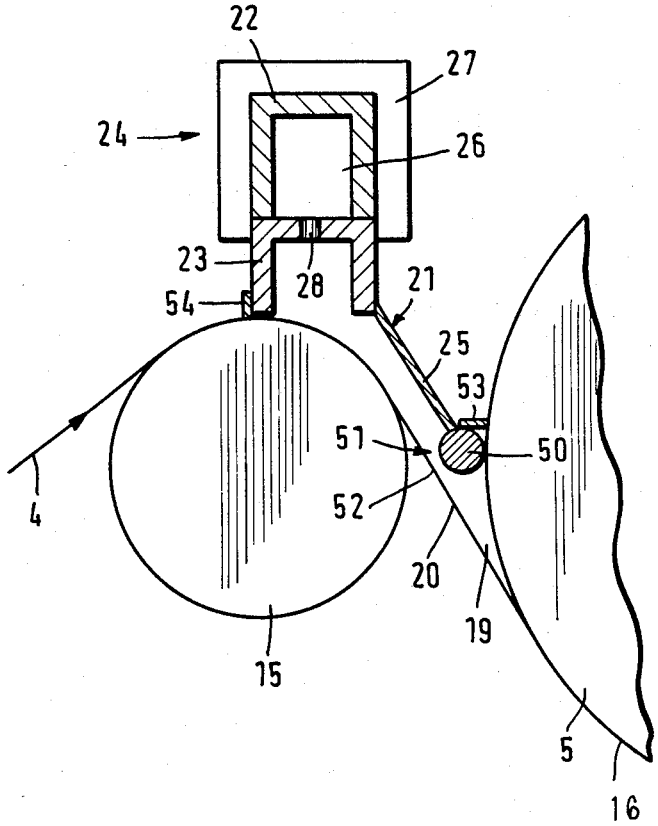
FIG. 2 is a fragmentary partly elevational and partly vertical sectional view of a detail in a modified winding apparatus.

That portion (20) of the web 4 which advances from the distancing roller 15 to the line 39 of contact with the roll 5 on the takeup reel 3 and the outermost convolution 16 of the roll 5 define a substantially gusset-shaped space 19 (see particularly FIG. 2). In accordance with a feature of the invention, the winding apparatus comprises means for reducing the pressure of air in the space 19, and such pressure reducing means comprises a composite wall 21 which at least partially seals the space 19 from the surrounding atmosphere. The wall 21 includes a first portion constituted by a hollow beam 24 which is assembled of two inverted U-shaped profiles 22, 23 extending in parallelism with the axis of the distancing roller 15, and a second portion 25 which can be made of sheet metal and is mounted on the lower profile 23 of the beam 24. The wall portion 25 comprises a preferably flexible end portion or wiper 29 which contacts the outermost convolution 16 and extends radially of the roll 5 upstream of the space 19. The wiper 29 constitutes a means for sweeping or stripping air away from the exposed surface of the outermost convolution 16. The profiles 22 and 23 of the beam 24 define an elongated suction chamber 26 which is parallel to the axes of the distancing roller 15 and takeup reel 3 and is connected with a suction generating device 27 (e.g., a suitable exhaust fan or suction pump) which evacuates air from the space 19 via suction ports 28. These parts form a row in the web of the lower profile 23 and establish communication between the suction chamber 26 and the space 19 along the full axial length of the roll 5. The end portion 29 of the wall portion 25 is located at a predetermined distance above a horizontal plane X—X which includes the common axis of the takeup reel 3 and roll 5 and is parallel with the direction (arrow 8) of reciprocatory movement of the carriage 7 along the arm 6. The end portion 29 and the monitoring device 17 are disposed at the opposite sides of and are preferably equidistant from the plane X—X. This ensures that the positions of the monitoring device 17 and end portion 29 of the wall portion 25 with reference to the outermost convolution 16 of the roll 5 remain unchanged irrespective of the rate of growth of the diameter of convoluted material on the takeup reel 3.

The lowermost portion 30 of the left-hand flange of the lower profile 23 of the beam 24 constitutes a second wiper which extends substantially radially of the distancing roller 15 and sweeps or strips the layer of air off the upper side of the running web 4 immediately ahead of the region of entry of successive increments of the web below the gusset-shaped space 19. The portion 30 of the profile 23 is preferably flexible and is sufficiently close to the upper side of the running web 4 to contribute to a reduction of the likelihood of entrapment of air between successive convolutions of the roll 5 by reducing the quantity of air which enters the space 19 with the running web 4.

The carriage 7 supports a pair of parallel guide rails 31 which make an acute angle with the plane X—X, i.e., with the direction (arrow 8) of reciprocatory movement of the carriage 7 along the arm 6, and which reciprocably support and guide a second carriage or slide 32 so that the latter is movable therealong along a straight path in directions indicated by a double-headed arrow 34. The second carriage 32 supports a biasing device 33 here shown as a roller whose axis is parallel to that of the distancing roller 15 and which is provided with an elastically deformable peripheral layer 36. The locus of substantially linear contact between the layer 36 of the biasing roller 33 and the exterior of the roll 5 on the takeup reel 3 is indicated at 37. This locus is disposed downstream of the straight line 39 of contact between the roll 5 and successive increments of the web portion 20. The means for moving the carriage 32 along the guide rails 3 comprises a hydraulic motor 35 which can constitute a double-acting cylinder and piston unit. The means for operating the motor 35 is designed in such a way that the distance from the locus 37 to the line 39 of contact between the web portion 20 and the roll 5 remains unchanged. To this end, the carriage 32 is moved downwardly and to the left, while the carriage 7 moves to the left, at a rate as indicated by the vertical lines within the hatched triangle 38. The positions ofthe locus 37 and line 39 when the diameter of the roll 5 reaches the maximum value (note the outermost convolution 16*a*) are respectively indicated at 37*a* and 39*a*. The phantom-line circle 33*a* denotes the position of the biasing roller 33 when the diameter of the roll 5 reaches its maximum value.

The motor 35 not only serves to move the carriage 32 along the guide rails 31 but it also determines the force with which the elastic layer 36 of the biasing roller 33 bears against the roll 5. The rate at which the carriage 32 moves along the rails 31 and the bias of the roller 33 upon the roll 5 are preferably determined in accordance with preselected programs to ensure expulsion of at least some additional air (if any) from between the neighboring convolutions of the roll 5. To this end, the chambers of the motor 35 are connected with a control unit 40 by conduit means 41 and 42. The unit 40 determines the rate of admission of pressurized fluid into and the rate of evacuation of fluid from the respective chambers of the motor 35. A fluid pressure monitoring device 43 of any known design (e.g., a gauge), is provided to monitor the pressure of fluid in the motor 35 and to generate signals which are transmitted via conductor means 44 to the corresponding input or inputs of the control unit 40. A further monitoring device 45 serves to generate signals which denote the position of the carriage 32 with reference to the guide rails 31 and carriage 7, and such signals are transmitted to the control unit 40 via conductor means 46. The control unit 40 cooperates with a first memory 47 which stores signals denoting the desired positions of the carriage 32 with reference to the guide rails 31 and a second memory 48 which stores signals denoting the desired pressure between the layer 36 of the biasing roller 33 and the roll 5. An input 49 is provided to initiate the transmission of signals from the memories 47 and 48 to the control unit 40 which latter utilizes such signals to operate the motor 35 and to thereby determine the position of the carriage 32 with reference to the guide rails 31 while the diameter of the roll 5 grows and the carriage 7 moves in a direction away from the takeup reel 3. The input 49 received signals from a device 149 which monitors the diameter of the growing roll 5. Such monitoring devices are used, for example, in cigarette making machines. The position of the carriage 32 with reference to the guide rails 31 is adjusted when the signals which are transmitted by the monitoring devices 43 and 45 deviate from the signals which are then supplied by the corresponding memories 47 and 48. The exact construction of the control unit 40 forms no part of the present invention; it suffices to say that this unit can regulate the flow of fluid (e.g., oil) in the conduits 41 and 42 when the intensities and/or other characteristics of signals furnished by the monitoring devices 43 and 45 deviate from the signals which are then transmitted by the corresponding memories.

When the suction generating device 27 is on, it ensures the establishment of suction in the space 19 to thus guarantee that the web portion 4 is stabilized in a region immediately ahead of the line 39 of contact between successive increments of the running web and the roll 5. Thus, the pressure reducing means can compensate for or eliminate vibrations or flutter which may or could develop when the web 4 is advanced at a high or very high speed. Such flutter is also controlled by appropriate selection of tension of the web 4 and of the spacing a between the distancing roller 15 and the roll 5. If a web having a predetermined thickness and advancing at a predetermined speed is to be properly convoluted on the takeup reel, it is necessary to regulate the tension of the web as well as to properly select the distance between the parts 3 and 15. The provision of our novel pressure reducing means including the suction generating device 27 renders it possible to further reduce the likelihood of uncontrolled movements of the web portion 20 even if the web 4 is convoluted at a high rate of speed. The suction generating device 27 is preferably adjustable; this renders it possible to regulate the suction in the space 19 and to even more accurately control the condition of the web upstream of the line 39. The provision of the biasing roller 33 (together with the controls for its movement relative to the carriage 7 and of its bias upon the roll 5) also contributes to predictability of the winding operation. The bias of the roller 33 and/or the rate of movement of the carriage 32 along the guide rails 31 can be used to further stabilize the roll 5 and to further reduce the quantity of air, if any, which remains entrapped between the convolutions of the roll 5.

FIG. 2 shows a portion of a modified winding apparatus wherein all such parts which are identical with or clearly analogous to corresponding parts of the first winding apparatus are denoted by the same reference characters. The pressure reducing means of the second winding apparatus comprises an elongated rod-shaped flow restrictor 50 which forms part of one portion 25 of the aforediscussed wall 21 and is in contact with or very close to the exposed side of the outermost convolution 16 of the roll 5. The convex (cylindrical) external surface of the flow restrictor 50 (which has a preferably circular cross-sectional outline) and the web portion 20 define a gap 51 which extends in the direction of travel of the web 4 toward the roll 5 and includes a relatively narrow central portion 52 and two relatively wider outer portions which flank the central portion 52 and whose width increases gradually in directions away from the central portion (this is due to the fact that the flow restrictor 50 has a circular cross-sectional outline and is parallel to the web portion 20 as well as to the distancing roller 15 and roll 5).

The apparatus of FIG. 2 also comprises a hollow beam 24 which includes a pair of superimposed profiles 22, 23. The suction chamber 26 is connected to the suction generating device 27 and communicates with the gusset-shaped space 19 via suction ports 28 in the web of the lower profile 23. When the suction generating device 27 is on and the chamber 26 draws air from the space 19 via suction ports 28, air which flows from the lower part of the space 19 is accelerated in the narrow central portion 52 of the gap 51 to thus cause a further reduction of pressure in the space 19 with attendant more pronounced stabilization of the web portion 20. The wipers 53 and 54 respectively correspond to the wipers 29 and 30 of FIG. 1. The wiper 53 is supported by the sheet-metal wall portion 25 (or forms an integral part of such wall portion) and is tangential to the flow restrictor 50 while extending radially or nearly radially of the roll 5. The wiper 54 forms part of or is mounted on the profile 23 of the beam 24 and extends radially or nearly radially of the distancing roller 15. It has been found that such wipers can greatly reduce the rate of air admission into the space 19 without damaging the web 4.

If the suction generating device 27 is omitted, the flow restrictor 50 constitutes a means for "squeezing" air which is caused to flow into the lower part of the space 19 with the upper side of the web portion 20. If the pressure reducing means uses a suction generating device, such device draws air from the space 19 whereby the flow restrictor 50 primarily serves to accelerate the outflowing air stream in the narrow central portion 52 of the gap 51. This also results in a reduction of pressure at the location (in the central portion 52 of the gap 51) where a more pronounced stabilization of the web portion 20 contributes even further to the making of satisfactory rolls. At the very least, more pronounced suction in the portion 52 of the gap 51 further contributes to the stabilizing action of suction which is generated by the device 27. Highly satisfactory results are obtained if the flow restrictor 50 forms part of the wall 21 and ensures practically complete sealing of the space 19 from the surrounding atmosphere in the region where the member 50 is closely adjacent to the outermost convolution 16 of the roll. Such sealing action is enhanced by the provision of the wiper 53. As can be readily seen in FIG. 2, the flow restrictor 50 can be said to constitute a partition which seals the space 19 all the way from the web portion 20 to the outermost convolution 16 of the roll 5 save for the relatively narrow or very narrow central portion 52 of the gap 51. It is clear that the illustrated simple flow restrictor 50 can be replaced by more complex flow restrictor means without departing from the spirit of the invention.

Each of the wipers 29, 30, 53, 54 may constitute an elongated brush with flexible bristles. Such wipers constitute relatively simple and inexpensive but highly effective means for preventing the outer side of the outermost convolution 16 from entraining air into the space 19 as well as for preventing the upper side of the web portion 20 from entraining any or from entraining large quantities of air into the space 19. This, in turn, renders it possible to operate with a relatively simple, compact and inexpensive suction generating device.

The pressure reducing means of the improved winding apparatus serves to reduce the pressure of air at that side of the web portion 20 which faces the roll 5. This ensures that the web portion 4 is attracted toward the roll and is thereby stabilized immediately prior to its conversion or merger into the outermost convolution of the growing roll 5. It has been found that a reduction of pressure in the space 19 results in a pronounced reduction or total elimination of flutter of the web portion 20, even if the web 4 is advanced at a high or very high speed. This, in turn, ensures that successive increments of the web portion 20 are converted into successive increments of the outermost convolution 16 of the roll 5 at a uniform rate without the development of folds, grooves or the initial stages of such unevennesses.

Suction in the space 19 need not be very pronounced. In fact, even a slight reduction of pressure in this space suffices to eliminate or greatly reduce flutter and to ensure the formation of a highly satisfactory roll wherein the quantity of air which is entrapped between successive convolutions is negligible or nil. Absence of air pockets between the convolutions of the roll 5 is desirable and advantageous because this renders it possible to subject the running web to less pronounced tensional stresses. Thus, the improved apparatus can form a hard or compact roll which contains little or no air even though the tension of the web 4 can be reduced well below that which is needed in conventional winding apparatus to form rolls or the same quality. The provision of the wall 21 contributes to greater effectiveness of suction in the space 19 and renders it possible to utilize a smaller and less expensive suction generating device whose energy requirements are low. Moreover, the wall 21 constitutes a shield or shroud which protects the fingers or other parts of the hands of an attendant from injury. The aforediscussed hollow beam 24 constitutes a simple and effective means for providing an elongated suction chamber which extends across the entire running web. The beam can constitute a portion of the aforediscussed wall 21, it can carry the other portion (25) of the wall, and it can support the wipers 29, 30 or 53, 54. The illustrated beam 24 imparts stability to the entire wall 21 and ensures adequate evacuation of air along the full length of the space 19.

Since the spacing a between the distancing roller 15 and the outermost convolution 16 of the roll 5 remains constant irrespective of the rate of growth of the diameter of the roll 5, the configuration of the gusset-shaped space 19 and the conditions prevailing in this space also remain at least substantially constant. This also holds true for the sealing action of the wall 21 since the wall shares all movements of the distancing roller 15 with reference to the roll 5. Attachment of the monitoring device 17 to the part 18 of the carriage 7 for the distancing roll 15 ensures that this monitoring device can invariably detect the outermost convolution 16 of the roll 5 and can control the movements of the carriage 7 by transmitting appropriate signals to the control circuit 117 for the adjusting motor 11. The aforediscussed mounting of the monitoring device 17 in a position of mirror symmetry to the end portion 29 (or 53) of the wall 21 with reference to the plane X—X also contributes to reliable and predictable generation of signals which control the operation of the motor 11. The just mentioned mounting of the end portion 29 or 53 further ensures that this end portion invariably remains in contact with or close to the outermost convolution 16 of the roll 5 irrespective of the rate at which the roll grows.

The biasing roller 33 not only expels additional air from the roll 5 but it also contributes to stabilization of the location of the line 39 of contact between the web portion 20 and the roll. This, in turn, ensures that the dimensions of the space 19 remain at least substantially constant (the deepmost part of the space 19 is located at the line 39). The aforementioned controls which determine the rate of movement of the carriage 32 along the guide rails 31 in dependency on the rate of growth of the diameter of the roll 5 also contribute to more satisfactory stabilization of the web portion 20 and to the making of a more satisfactory roll because the distance between the line 39 and the locus 37 of contact between the roll 5 and the biasing roller 33 remains unchanged while the diameter of the roll increases. Thus, the depth of the space 19 remains at least substantially unchanged because the distance between the line 39 and the locus 37 remains unchanged. Such constancy of the distance between 37 and 39 is achieved by the simple expedient of selecting a proper inclination of the rails 31 with reference to the direction (arrow 8) of movement of the carriage 7 and distancing roller 15 along the ways which are defined by the arm 6 of the frame 1.

Suitable programming of movements of the carriage 32 along the guide rails 31 ensures that the distance between the line 39 and locus 37 remains at least substantially unchanged. Moreover, such programming prevents the application of excessive or insufficient pressure against the roll 5 immediately or shortly downstream of the line 37 of contact between such roll and successive increments of the web portion 20. The feature that a relatively simple motor 35 suffices to adjust the position of the biasing roller 33 as a function of changes in the diameter of the roll 5 as well as for the purpose of adjusting or selecting an appropriate pressure between this roller and the convoluted material contributes to simplicity of the winding apparatus. The pressure between the biasing roller 33 and the roll 5 can remain constant irrespective of the diameter of the roll. However, it is normally preferred to gradually reduce such pressure in response to increasing diameter of the convoluted material.

The improved winding apparatus is susceptible of many additional modifications without departing from the spirit of the invention. For example, the suction generating device 27 can be omitted if the apparatus employs the flow restrictor 50, i.e., the flow restrictor 50 can constitute the sole means for reducing the pressure in the space 19 between the web portion 20 and the outermost convolution 16 of the roll 5. Also, the biasing roller 33 can be mounted on a lever which is pivotable about the axis of the distancing roller 15; of course, such simplified mounting of the roller 33 cannot ensure that the distance between the line 39 and the locus 37 of contact between the web portion 20 and the roll 5 will remain unchanged while the diameter of the roll 5 grows. Moreover, the means for moving the distancing roller 15 with reference to the takeup reel 3 can be replaced with or used in addition to suitable means for moving the takeup reel with reference to the distancing roller. Still further, the hydraulic motor 35 can be replaced with a pneumatic motor or a hydropneumatic motor. All such and many other modifications will be readily comprehended by those skilled in the art without additional illustrations.

The memories 47 and 48 may be of the type as distributed under the name of:

Pos.43—fluid pressure monitor and transmitter. Hottinger Baldwin Messtechnik GmbH, Darmstadt pressure monitor with amplifier Typ P4V, precision classification 0,5, norm pressure 100 bar, frequency range 0–2000 Hz Pos.45—distance monitor. Hottinger Balduin Messtechnik, Darmstadt. Induction distance monitor Typ W 50 TS, nominal stroke range ±50 mm, precision classification 0,4, with base frequency amplifier Typ MGE 8301, precision classification 0,2, base frequency 5 kHz, metering range 0–200 Hz Pos.17—photoelectric switch Omron, Düsseldorf, analog light barrier Typ OPE-Y20, with amplifier Typ OPE VA output 0–5 V Pos.47/48—memories Hartmann & Braun, Frankfurt/M., electronic function former Typ FN 312, reforming of a non-linear input function to a function with 6 linear divisions or vice-versa Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for convoluting a web of paper or the like, comprising a driven rotary takeup device; means for feeding the web to said takeup device along a predetermined path so that the takeup device converts the running web into a growing roll of neighboring convolutions, said feeding means comprising a distancing device which is adjacent to a predetermined portion of said path and is spaced apart from the outermost convolution of the growing roll on said takeup device, said distancing device being arranged to direct the running web substantially tangentially toward the roll on the takeup device so that the outermost convolution of the roll and the web portion between said distancing device and the roll define a substantially gusset-shaped space; means for moving at least one of said devices with reference to the other of said devices so as to maintain the spacing between said distancing device and the outermost convolution of the roll on said takeup device at an at least substantially constant value; and means for reducing the pressure of air at least at one side of the running web intermediate said distancing device and the outermost convolution of the roll on said takeup device, said pressure reducing means including means for generating suction in said space.

2. The apparatus of claim 1, wherein said one side of the running web faces the roll on said takeup device.

3. The apparatus of claim 1, wherein said pressure reducing means includes suction generating means.

4. The apparatus of claim 1, wherein said pressure reducing means further includes wall means at least partially separating said gusset-shaped space from the surrounding atmosphere.

5. The apparatus of claim 4, wherein said distancing device comprises a roller and said wall means extends from the periphery of said roller to the outermost convolution of the roll on said takeup device.

6. The apparatus of claim 1, wherein said distancing device comprises a roller and said pressure reducing means further includes means defining a suction chamber extending in substantial parallelism with said roller, said chamber defining means having a series of suction ports extending in substantial parallelism with the axis of said roller and establishing communication between said space and said chamber.

7. The apparatus of claim 6, wherein said chamber defining means includes an elongated hollow beam which is parallel to the axis of said roller.

8. The apparatus of claim 7, wherein said pressure reducing means further comprises wall means at least partially separating said space from the surrounding atmosphere, said wall means including a first portion constituting said beam and a second portion carried by said beam and extending to the outermost convolution of the roll on said takeup device.

9. The apparatus of claim 1, further comprising means for stripping air from the exposed surface of the outermost convolution of the roll on said takeup device.

10. The apparatus of claim 9, wherein said stripping means comprises a flexible wiper.

11. The apparatus of claim 9, wherein said stripping means extends substantially radially of the roll on said takeup device.

12. The apparatus of claim 1, further comprising means for stripping air from one side of the running web in the region of said distancing device.

13. The apparatus of claim 12, wherein said stripping means comprises a flexible wiper.

14. Apparatus for convoluting a web of paper or the like, comprising a driven rotary takeup device; means for feeding the web to said takeup device along a predetermined path so that the takeup device converts the running web into a growing roll of neighboring convolutions, said feeding means comprising a distancing device which is adjacent to a predetermined portion of said path and is spaced apart from the outermost convolution of the growing roll on said takeup device; means for moving at least one of said devices with reference to the other of said devices so as to maintain the spacing between said distancing device and the outermost convolution of the roll on said takeup device at an at least substantially constant value; and means for reducing the pressure of air at least at one side of the running web intermediate said distancing device and the outermost convolution of the roll on said takeup device, comprising a flow restrictor adjacent to the outermost convolution of the roll on said takeup device and defining with the web portion between said distancing device and the roll a gap having a central portion of lesser width and outer portions of greater width, said gap extending in the direction of advancement of the web from said distancing device to the roll on said takeup device.

15. The apparatus of claim 14, wherein said distancing device is arranged to direct the running web substantially tangentially toward the roll on the takeup device so that the outermost convolution of the roll and the web portion between said distancing device and the roll define a substantially gusset-shaped space, said pressure reducing means including means for generating suction in said space.

16. The apparatus of claim 14, wherein said flow restrictor has a convex surface and the width of the outer portions of said gap increases gradually in directions away from said central portion.

17. The apparatus of claim 14, wherein said pressure reducing means further comprises wall means extending between said distancing device and the roll on said takeup device, said wall means comprising a first portion including said flow restrictor and a second portion.

18. The apparatus of claim 17, wherein said distancing device is arranged to direct the web substantially tangentially of and toward the roll on said takeup device so that the outermost convolution of the roll and the web portion between said distancing device and the roll define a substantially gusset-shaped space, said wall means being arranged to at least substantially seal said space from the surrounding atmosphere.

19. The apparatus of claim 14, wherein said flow restrictor includes an elongated member having a substantially circular cross-sectional outline.

20. Apparatus for convoluting a web of paper or the like, comprising a driven rotary takeup device; means for feeding the web to said takeup device along a predetermined path so that the takeup device converts the running web into a growing roll of neighboring convolutions, said feeding means comprising a distancing device which is adjacent to a predetermined portion of said path and is spaced apart from the outermost convolution of the growing roll on said takeup device; means for moving at least one of said devices with reference to the other of said devices so as to maintain the spacing between said distancing device and the outermost convolution of the roll on said takeup device at an at least substantially constant value; means for reducing the pressure of air at least at one side of the running web intermediate said distancing device and the outermost convolution of the roll on said takeup device; and means for stripping air from one side of the running web in the region of said distancing device, said distancing device comprising a roller and said stripping means extending substantially radially of said roller.

21. Apparatus for convoluting a web of paper or the like, comprising a driven rotary takeup device; means for feeding the web to said takeup device along a predetermined path so that the takeup device converts the running web into a growing roll or neighboring convolutions, said feeding means comprising a distancing device which is adjacent to a predetermined portion of said path and is spaced apart from the outermost convolution of the growing roll on said takeup device; means for moving at least one of said devices with reference to the other of said devices so as to maintain the spacing between said distancing device and the outermost convolution of the roll on said takeup device at an at least substantially constant value, comprising adjusting means operable to continuously shift said one device, signal generating means for monitoring the spacing between said distancing device and the roll on said takeup device, and means for operating said adjusting means in response to the signals from said monitoring means; and means for reducing the pressure of air at least at one side of the running web intermediate said distancing device and the outermost convolution of the roll on said takeup device.

22. The apparatus of claim 21, wherein said distancing device comprises a roller which constitutes said one device and further comprising bearing means for said roller, said moving means being arranged to move said bearing means in a predetermined direction and said monitoring means being movable with said bearing means and being arranged to monitor the spacing between said roller and the outermost convolution of the roll on said takeup device.

23. The apparatus of claim 22, wherein said roller is arranged to direct the running web substantially tangentially of the outermost convolution of the roll on said takeup device so that the outermost convolution and the web portion between said roller and the roll define a substantially gusset-shaped space, said pressure reducing means including wall means arranged to at least substantially seal said space from the surrounding atmosphere, said wall means having an end portion adjacent to the outermost convolution of the roll on said takeup device, said monitoring means and the end portion of said wall means being substantially mirror symmetrical to one another with reference to a plane including the axis of rotation of said takeup device and extending in parallelism with said predetermined direction.

24. Apparatus for convoluting a web of paper or the like, comprising a driven rotary takeup device; means for feeding the web to said takeup device along a predetermined path so that the takeup device converts the running web into a growing roll of neighboring convolutions, said feeding means comprising a distancing device which is adjacent to a predetermined portion of said path and is spaced apart from the outermost convolution of the growing roll on said takeup device, said distancing device being arranged to direct the web substantially tangentially of the roll on said takeup device and to thus establish a predetermined line of contact between successive increments of the running web and the roll, such line of contact being at least substantially parallel to the axis of the roll on the takeup device; means for moving at least one of said devices with reference to the other of said devices so as to maintain the spacing between said distancing device and the outermost convolution of the roll on said takeup device at an at least substantially constant value, said distancing device engaging the web at one side of said line of contact; means for reducing the pressure of air at least at one side of the running web intermediate said distancing device and the outermost convolution of the roll on said takeup device; and means for biasing the web against the roll at the other side of said line of contact.

25. The apparatus of claim 24, wherein said biasing means comprises a roller whose axis is parallel to the axis of the roll on the takeup device and which is in substantially linear contact with the outer side of the outermost convolution of the roll and further comprising means for moving said roller relative to said takeup device so that the distance between said line of contact and the locus of linear contact between the roller and the web remains at least substantially unchanged while the diameter of the roll on the takeup device increases.

26. The apparatus of claim 25, wherein the means for moving said roller comprises a carriage and means for moving the carriage along a path which makes an acute angle with the direction of movement of said one device.

27. The apparatus of claim 26, wherein said one device is said distancing device, said distancing device comprising a second roller and the means for moving said distancing device including bearing means for said second roller and means for moving said bearing means along a second predetermined path, and further comprising guide means defining for said carriage a third path which makes said acute angle with said second path.

28. The apparatus of claim 25, wherein the means for moving said roller comprises means for shifting said roller with reference to said one device in accordance with a preselected program which is a function of the rate of growth of the roll on said takeup device.

29. The apparatus of claim 25, wherein said means for moving said roller comprises means for regulating the bias of said roller upon the roll on said takeup device.

30. The apparatus of claim 29, wherein the means for moving said roller further comprises means for changing the distance between said roller and said takeup device as a function of the growing diameter of the roll on said takeup device.

31. The apparatus of claim 25, wherein the means for moving said roller comprises at least fluid-operated motor.

32. The apparatus of claim 31, further comprising means for monitoring the pressure of fluid in said motor and means for changing the pressure of fluid in said motor when the monitored pressure deviates from a predetermined range of values as the diameter of the roll on said takeup device increases.

33. Apparatus for convoluting a web of paper or the like, comprising a driven rotary takeup device; means for feeding the web to said takeup device along a predetermined path so that the takeup device converts the running web into a growing roll of neighboring convolutions, said feeding means comprising a distancing device which is adjacent to a predetermined portion of said path and is spaced apart from the outermost convolution of the growing roll on said takeup device; means for moving at least one of said devices with reference to the other of said devices so as to maintain the spacing between said distancing device and the outermost convolution of the roll on said takeup device at an at least substantially constant value, comprising adjusting means operable to shift said one device, signal generating means for monitoring the spacing between said distancing device and the roll on said takeup device, and means for operating said adjusting means in response to signals from said monitoring means; and means for reducing the pressure of air at least at one side of the running web intermediate said distancing device and the outermost convolution of the roll on said takeup device.

* * * * *